US011008635B2

(12) United States Patent
Yoshioka et al.

(10) Patent No.: US 11,008,635 B2
(45) Date of Patent: May 18, 2021

(54) HIGH-STRENGTH COLD-ROLLED STEEL SHEET

(71) Applicant: JFE Steel Corporation, Tokyo (JP)

(72) Inventors: Shimpei Yoshioka, Tokyo (JP); Yoshihiko Ono, Tokyo (JP); Yusuke Kimata, Tokyo (JP); Hiroyuki Masuoka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 312 days.

(21) Appl. No.: 16/077,266

(22) PCT Filed: Feb. 15, 2017

(86) PCT No.: PCT/JP2017/005467
§ 371 (c)(1),
(2) Date: Aug. 10, 2018

(87) PCT Pub. No.: WO2017/141953
PCT Pub. Date: Aug. 24, 2017

(65) Prior Publication Data

US 2019/0040490 A1 Feb. 7, 2019

(30) Foreign Application Priority Data

Feb. 18, 2016 (JP) ..... JP2016-028881

(51) Int. Cl.
*C22C 38/16* (2006.01)
*C22C 38/60* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... C21D 9/46; C21D 8/0273; C21D 8/0278; C21D 6/002; C21D 8/0263; C21D 6/005;
(Continued)

(56) References Cited

U.S. PATENT DOCUMENTS 10,077,486 B2 9/2018 Takashima et al.
2009/0014095 A1 1/2009 Mukai et al.
(Continued)

FOREIGN PATENT DOCUMENTS

CN 102119234 A 7/2011
CN 102959130 A 3/2013
(Continued)

OTHER PUBLICATIONS

Korean Grant of Patent for Korean Application No. 10-2018-7023533, dated Mar. 5, 2020, with translation, 2 pages.
(Continued)

*Primary Examiner* — John A Hevey
(74) *Attorney, Agent, or Firm* — Ratnerprestia

(57) ABSTRACT

Provided is a high-strength cold-rolled steel sheet has a chemical composition containing, by mass %, C: 0.10% or more and 0.6% or less, Si: 1.0% or more and 3.0% or less, Mn: more than 2.5% and 10.0% or less, P: 0.05% or less, S: 0.02% or less, Al: 0.01% or more and 1.5% or less, N: 0.005% or less, Cu: 0.05% or more and 0.50% or less, and the balance being Fe and inevitable impurities, and a tensile strength of 1180 MPa or more, in which a steel sheet surface coverage of oxides mainly containing Si is 1% or less, a steel sheet surface coverage of iron-based oxides is 40% or less, $Cu_S/Cu_B$ is 4.0 or less, and a tensile strength is 1180 MPa or more, where $Cu_S$ denotes a Cu concentration in a surface layer of a steel sheet and $Cu_B$ denotes a Cu concentration in base steel.

11 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/20*** | (2006.01) |
| ***C22C 38/34*** | (2006.01) |
| ***C22C 38/32*** | (2006.01) |
| ***C22C 38/38*** | (2006.01) |
| ***C21D 9/46*** | (2006.01) |
| ***C21D 6/00*** | (2006.01) |
| ***C21D 8/02*** | (2006.01) |

(52) U.S. Cl.

CPC ..... *C21D 8/0205* (2013.01); *C21D 8/0226* (2013.01); *C21D 8/0236* (2013.01); *C21D 8/0263* (2013.01); *C21D 8/0273* (2013.01); *C21D 8/0278* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/10* (2013.01); *C22C 38/12* (2013.01); *C22C 38/14* (2013.01); *C22C 38/16* (2013.01); *C22C 38/20* (2013.01); *C22C 38/32* (2013.01); *C22C 38/34* (2013.01); *C22C 38/38* (2013.01); *C22C 38/60* (2013.01); *C21D 2211/001* (2013.01); *C21D 2211/002* (2013.01); *C21D 2211/008* (2013.01)

(58) Field of Classification Search

CPC .... C21D 6/008; C21D 8/0205; C21D 8/0226; C21D 8/0236; C21D 2211/008; C21D 2211/002; C21D 2211/001; C22C 38/34; C22C 38/32; C22C 38/38; C22C 38/001; C22C 38/002; C22C 38/005; C22C 38/008; C22C 38/02; C22C 38/04; C22C 38/06; C22C 38/10; C22C 38/12; C22C 38/14; C22C 38/20; C22C 38/16; C22C 38/60

See application file for complete search history.

(56) References Cited

U.S. PATENT DOCUMENTS

| | | | | |
|---|---|---|---|---|
| 2013/0087257 | A1 | 4/2013 | Yoshino et al. | |
| 2013/0149526 | A1* | 6/2013 | Masuoka | C22C 38/04 428/332 |
| 2013/0149529 | A1 | 6/2013 | Masuoka et al. | |
| 2014/0170439 | A1 | 6/2014 | Allain et al. | |
| 2014/0373980 | A1 | 12/2014 | Hayashi et al. | |
| 2015/0299834 | A1 | 10/2015 | Mizuta et al. | |
| 2016/0177414 | A1* | 6/2016 | Takashima | C22C 38/12 148/652 |
| 2017/0088914 | A1 | 3/2017 | Ikeda et al. | |
| 2018/0305784 | A1 | 10/2018 | Fujimura et al. | |
| 2020/0071784 | A1* | 3/2020 | Yoshioka | C22C 38/16 |

FOREIGN PATENT DOCUMENTS

| | | | | |
|---|---|---|---|---|
| CN | 104508155 | A | 4/2015 | |
| EP | 1342801 | A1 | 9/2003 | |
| EP | 2312007 | A1 | 4/2011 | |
| EP | 2612956 | A1 | 7/2013 | |
| EP | 2612957 | A1 | 7/2013 | |
| EP | 3009527 | A1 | 4/2016 | |
| EP | 3178949 | A1 | 6/2017 | |
| JP | 3545980 | B2 | 7/2004 | |
| JP | 4362318 | B2 | 11/2009 | |
| JP | 2011231377 | A | 11/2011 | |
| JP | 2012012642 | A | 1/2012 | |
| JP | 2012132092 | A | 7/2012 | |
| JP | 2012172183 | A | 9/2012 | |
| JP | 2013124383 | A | 6/2013 | |
| JP | 2013173976 | A | 9/2013 | |
| JP | 5729211 | A | 6/2015 | |
| JP | 2015193907 | A | 11/2015 | |
| KR | 20130031285 | A | 3/2013 | |
| KR | 20140012167 | A | 1/2014 | |
| KR | 20160012205 | A | 2/2016 | |
| KR | 20080100835 | A | 11/2018 | |
| WO | 2015019558 | A1 | 2/2015 | |
| WO | WO-2015019558 | A1 * | 2/2015 | C21D 6/004 |
| WO | 2016021196 | A1 | 2/2016 | |

OTHER PUBLICATIONS

Chinese Office Action for Chinese Application No. 201780011827.4, dated Oct. 24, 2019 with Concise Statement of Relevance of Office Action, 13 pages.

Non Final Office Action for U.S. Appl. No. 15/999,603, dated May 19, 2020, 20 pages.

International Search Report and Written Opinion for International Application No. PCT/JP2017/005467, dated May 23, 2017—5 pages.

Extended European Search Report for European Application No. 17 753 209.0. dated Nov. 29, 2018, 10 pages.

Korean Office Action for Korean Application No. 10-2018-7023533, dated Sep. 16, 2019 with Concise Statement of Relevance of Office Action, 7 pages.

Non Final Office Action for U.S. Appl. No. 15/999,603, dated Sep. 10, 2020, 19 pages.

* cited by examiner

HIGH-STRENGTH COLD-ROLLED STEEL SHEET

CROSS REFERENCE TO RELATED APPLICATIONS

This is the U.S. National Phase application of PCT/JP2017/005467, filed Feb. 15, 2017, which claims priority to Japanese Patent Application No. 2016-028881, filed Feb. 18, 2016, the disclosures of each of these applications being incorporated herein by reference in their entireties for all purposes.

FIELD OF THE INVENTION

The present invention relates to a high-strength cold-rolled steel sheet which is excellent in terms of delayed fracture resistance and chemical convertibility, which is characterized by having a tensile strength of 1180 MPa or more.

BACKGROUND OF THE INVENTION

Nowadays, in response to the need for reducing $CO_2$ emission and for collision safety, weight reduction and strengthening of automobile bodies are underway. Although a steel sheet having a tensile strength of 980 MPa grade is mainly used for automobiles currently, since there is a growing demand for increasing the strength of a steel sheet, there is a demand for developing a high-strength steel sheet having a tensile strength of more than 1180 MPa. However, in the case where there is an increase in the strength of a steel sheet, there is a decrease in ductility, and there is a risk of delayed fracture due to hydrogen entering from the environment.

In addition, since an automotive steel sheet is used in a painted state, the steel sheet is subjected to a chemical conversion treatment such as a phosphating treatment as a pretreatment of such painting. Since such a chemical conversion treatment is one of the important treatments performed on a steel sheet in order to achieve satisfactory corrosion resistance after painting has been performed, an automotive steel sheet is required to have excellent chemical convertibility.

Si is a chemical element which increases the ductility of a steel sheet while maintaining the strength of the steel sheet through solid solution strengthening of ferrite and decreasing the grain diameter of carbides inside martensite or bainite. In addition, since Si inhibits the formation of carbides, Si facilitates the formation of a sufficient amount of retained austenite, which contributes to an increase in ductility. Moreover, it is known that, since Si decreases the degree of concentration of stress and strain in the vicinity of grain boundaries by decreasing the grain diameter of grain boundary carbides inside martensite or bainite, there is an improvement in delayed fracture resistance. Therefore, many methods for manufacturing a high-strength thin steel sheet utilizing Si have been disclosed.

Patent Literature 1 describes a steel sheet excellent in terms of delayed fracture resistance having a chemical composition containing, by mass %, 1% to 3% of Si, a microstructure including ferrite and tempered martensite, and a tensile strength of 1320 MPa or more.

Examples of a chemical element which improves delayed fracture resistance include Cu. According to Patent Literature 2, there is a significant improvement in delayed fracture resistance due to an improvement in the corrosion resistance of a steel sheet as a result of adding Cu. In addition, the Si content in Patent Literature 2 is 0.05 mass % to 0.5 mass %.

Patent Literature 3 describes a steel sheet having a chemical composition containing, by mass %, 0.5% to 3% of Si and 2% or less of Cu and excellent chemical convertibility. In Patent Literature 3, excellent chemical convertibility is achieved despite the Si content of 0.5% or more by pickling the surface of a steel sheet, which has been subjected to continuous annealing, in order to remove a Si-containing oxide layer formed on the surface layer of a steel sheet when annealing is performed.

Patent Literature

PTL 1: Japanese Unexamined Patent Application Publication No. 2012-12642

PTL 2: Japanese Patent No. 3545980

PTL 3: Japanese Patent No. 5729211

SUMMARY OF THE INVENTION

In the case of the manufacturing method according to Patent Literature 1, since a Si-containing oxide layer is formed on the surface of a steel sheet in a continuous annealing line, it is difficult to say that sufficient chemical convertibility is achieved. In addition, even in the case where the Si content is further increased, the effect of Si becomes saturated, and there are manufacturing problems such as an increase in hot rolling load.

In the case of the technique according to Patent Literature 2, since the Si content is small, satisfactory delayed fracture resistance or formability is not achieved.

In the case of the technique according to Patent Literature 3, since Cu is re-precipitated on the surface of a steel sheet due to base steel being dissolved when pickling is performed as described above, the dissolving reaction of iron is inhibited in a region where Cu is precipitated when a chemical conversion treatment is performed, which results in a problem in that the precipitation of chemical conversion crystals such as zinc phosphate is inhibited.

In the case of a high-strength steel sheet having a risk of delayed fracture due to corrosion, since there is a growing demand for chemical convertibility regarding paint adhesiveness, there is a demand for developing a steel sheet with which good chemical convertibility is achieved even under more severe treatment conditions.

The present invention has been completed in view of the situation described above, and an object of the present invention is to provide a high-strength cold-rolled steel sheet excellent in terms of delayed fracture resistance and chemical convertibility characterized by having a tensile strength of 1180 MPa or more.

As described above, although Si-containing oxides on the surface of a steel sheet are removed by pickling the surface of the steel sheet which has been subjected to continuous annealing, it is not possible to achieve good chemical convertibility due to Cu being re-precipitated on the surface of the steel sheet.

The present inventors diligently conducted investigations in order to solve the problems described above and, as a result, found that it is possible to prevent a decrease in chemical convertibility due to Si and Cu and to improve delayed fracture resistance by performing pickling following continuous annealing as described above in order to remove a Si-containing oxide layer on the surface layer of a steel sheet and by controlling $Cu_S/Cu_B$ ($Cu_S$ denotes a Cu concentration in the surface layer of a steel sheet, and $Cu_B$ denotes a Cu concentration in base steel) to be 4.0 or less.

The present invention is based on the knowledge described above. That is, the subject matter of the present invention according to exemplary embodiments is as follows.

[1] A high-strength cold-rolled steel sheet having a chemical composition containing, by mass %, C: 0.10% or more and 0.6% or less, Si: 1.0% or more and 3.0% or less, Mn: more than 2.5% and 10.0% or less, P: 0.05% or less, S: 0.02% or less, Al: 0.01% or more and 1.5% or less, N: 0.005% or less, Cu: 0.05% or more and 0.50% or less, and the balance being Fe and inevitable impurities, in which a steel sheet surface coverage of oxides mainly containing Si is 1% or less, a steel sheet surface coverage of iron-based oxides is 40% or less, $Cu_S/Cu_B$ is 4.0 or less, and a tensile strength is 1180 MPa or more, where $Cu_S$ denotes a Cu concentration in a surface layer of a steel sheet and $Cu_B$ denotes a Cu concentration in base steel.

[2] The high-strength cold-rolled steel sheet according to item [1], the steel sheet has a microstructure including, in terms of volume ratio, tempered martensite and/or bainite in a total amount of 40% or more and 100% or less, ferrite in an amount of 0% or more and 60% or less, and retained austenite in an amount of 2% or more and 30% or less, and (tensile strength×total elongation) is 16500 MPa·% or more.

[3] The high-strength cold-rolled steel sheet according to item [1] or [2], [Si]/[Mn] ([Si] denotes the Si content (mass %), and [Mn] denotes the Mn content (mass %)) is more than 0.40.

[4] The high-strength cold-rolled steel sheet according to any one of items [1] to [3], the steel sheet has the chemical composition further containing, by mass %, one or more of Nb: 0.2% or less, Ti: 0.2% or less, V: 0.5% or less, Mo: 0.3% or less, Cr: 1.0% or less, and B: 0.005% or less.

[5] The high-strength cold-rolled steel sheet according to any one of items [1] to [4], the steel sheet has the chemical composition further containing, by mass %, one or more of Sn: 0.1% or less, Sb: 0.1% or less, W: 0.1% or less, Co: 0.1% or less, Ca: 0.005% or less, and REM: 0.005% or less.

The high-strength cold-rolled steel sheet according to embodiments of the present invention is excellent in terms of delayed fracture resistance and chemical convertibility despite having a tensile strength of 1180 MPa or more.

DETAILED DESCRIPTION OF EMBODIMENTS OF THE INVENTION

Figure 1:
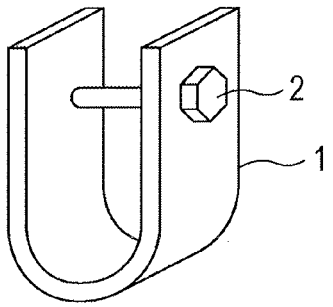
FIG. 1 is a schematic diagram of a test piece used for evaluating delayed fracture resistance.

Hereafter, the embodiments of the present invention will be described. Here, the present invention is not limited to the embodiments below.

First, the chemical composition of the high-strength steel sheet according to the present invention (also referred to as "steel sheet according to the present invention") will be described. The chemical composition of the steel sheet according to embodiments of the present invention has a chemical composition containing, by mass %, C: 0.10% or more and 0.6% or less, Si: 1.0% or more and 3.0% or less, Mn: more than 2.5% and 10.0% or less, P: 0.05% or less, S: 0.02% or less, Al: 0.01% or more and 1.5% or less, N: 0.005% or less, Cu: 0.05% or more and 0.50% or less, and the balance being Fe and inevitable impurities.

In addition, the chemical composition described above may further contain, by mass %, one or more of Nb: 0.2% or less, Ti: 0.2% or less, V: 0.5% or less, Mo: 0.3% or less, Cr: 1.0% or less, and B: 0.005% or less.

In addition, the chemical composition described above may further contain, by mass %, one or more of Sn: 0.1% or less, Sb: 0.1% or less, W: 0.1% or less, Co: 0.1% or less, Ca: 0.005% or less, and REM: 0.005% or less.

Hereafter, the content of each of the constituent chemical elements will be described. Here, "%" used when describing the content of a constituent chemical element denotes "mass %" in the description below.

C: 0.10% or More and 0.6% or Less

C is a chemical element which is effective for improving the strength-ductility balance of a steel sheet. In the case where the C content is less than 0.10%, it is difficult to achieve a tensile strength of 1180 MPa or more. On the other hand, in the case where the C content is more than 0.6%, since cementite having a large grain diameter is precipitated, such cementite having a large grain diameter becomes a starting point at which hydrogen cracking occurs. Therefore, the C content is set to be 0.10% or more and 0.6% or less. It is preferable that the lower limit of the C content be 0.15% or more. It is preferable that the upper limit of the C content be 0.4% or less.

Si: 1.0% or More and 3.0% or Less

Si is a chemical element which is effective for achieving satisfactory strength without significantly decreasing the ductility of a steel sheet. In the case where the Si content is less than 1.0%, it is not possible to achieve high strength and high formability (excellent formability), and there is a deterioration in delayed fracture resistance because it is not possible to inhibit an increase in the grain diameter of cementite. In addition, in the case where the Si content is more than 3.0%, there is an increase in rolling load when hot rolling is performed, and there is a decrease in chemical convertibility due to the generation of oxidized scale on the surface of a steel sheet. Therefore, the Si content is set to be 1.0% or more and 3.0% or less. It is preferable that the lower limit of the Si content be 1.2% or more. It is preferable that the upper limit of the Si content be 2.0% or less.

Mn: More than 2.5% and 10.0% or Less

Mn is a chemical element which is effective for increasing the strength of steel and for stabilizing austenite. On the other hand, in the case where the Mn content is excessively large, a steel microstructure in which ferrite and martensite are distributed in zones due to segregation occurring when casting is performed is formed. As a result, mechanical property anisotropy occurs, which results in deterioration in formability. Moreover, there is a significant deterioration in delayed fracture resistance due to the formation of MnS having a larger grain diameter. Therefore, the Mn content is set to be more than 2.5% and 10.0% or less. It is preferable that the lower limit of the Mn content be 2.7% or more. It is preferable that the upper limit of the Mn content be 4.5% or less.

[Si]/[Mn]: More than 0.40

Each of the amounts of oxides mainly containing Si, and Si—Mn complex oxides depends on the balance between the Si content and the Mn content. In the case where the amount of one or the other of such kinds of oxides formed is significantly large, since it is not possible to completely remove oxides on the surface of a steel sheet even by performing pickling again after pickling has been performed, there may be a decrease in chemical convertibility. Therefore, it is preferable that the ratio of the Si content to the Mn content be specified. In the case where the Mn content is excessively large compared with the Si content, that is, in the case where [Si]/[Mn] is 0.4 or less, since there may be a case where an excessively large amount of oxides mainly containing Si—Mn is formed, there may be a case where it is not possible to achieve the chemical convertibility for which the present invention is intended. Therefore, it is preferable that [Si]/[Mn] be more than 0.4. In addition, from the relationship between the upper limit of the Si content and the lower limit of the Mn content, [Si]/[Mn] is less than 1.2. Here, [Si] denotes the Si content, and [Mn] denotes the Mn content.

P: 0.05% or Less

P is an impurity chemical element. In the case where the P content is more than 0.05%, since grain-boundary embrittlement occurs due to P being segregated at austenite grain boundaries when casting is performed, there is a deterioration in the delayed fracture resistance of a steel sheet after forming has been performed due to a decrease in local ductility. Therefore, it is preferable that the P content be 0.05% or less, or more preferably 0.02% or less. Here, in consideration of manufacturing costs, it is preferable that the P content be 0.001% or more.

S: 0.02% or Less

S causes deterioration in impact resistance, strength, and delayed fracture resistance by existing in the form of MnS in a steel sheet. Therefore, it is preferable that the S content be as small as possible. Therefore, the upper limit of the S content is set to be 0.02%, preferably 0.002% or less, or more preferably 0.001% or less. Here, in consideration of manufacturing costs, it is preferable that the S content be 0.0001% or more.

Al: 0.01% or More and 1.5% or Less

Since Al decreases the amounts of oxides formed of, for example, Si by forming oxides of its own, Al is effective for improving delayed fracture resistance. However, in the case where the Al content is less than 0.01%, it is not possible to realize a significant effect. In addition, in the case where the Al content is more than 1.5%, Al combines with N to form nitrides. Since nitrides cause grain-boundary embrittlement as a result of being precipitated at austenite grain boundaries when casting is performed, there is a deterioration in delayed fracture resistance. Therefore, the Al content is set to be 1.5% or less, preferably less than 0.08%, or more preferably 0.07% or less.

N: 0.005% or Less

N deteriorates delayed fracture resistance by combining with Al to form nitrides as described above. Therefore, it is preferable that the N content be as small as possible. Therefore, the N content is set to be 0.005% or less, or preferably 0.003% or less. Here, in consideration of manufacturing costs, it is preferable that the N content be 0.0001% or more.

Cu: 0.05% or More and 0.50% or Less

Since Cu inhibits the dissolution of a steel sheet when the steel sheet is exposed to a corrosive environment, Cu is effective for decreasing the amount of hydrogen which enters a steel sheet. In the case where the Cu content is less than 0.05%, such an effect is small. In addition, in the case where the Cu content is more than 0.50%, it is difficult to control pickling conditions for achieving the specified Cu concentration distribution in the surface layer. Therefore, the Cu content is set to be 0.05% or more and 0.50% or less. It is preferable that the lower limit of the Cu content be 0.08% or more. It is preferable that the upper limit of the Cu content be 0.3% or less.

In the present invention, one or more of Nb, Ti, V, Mo, Cr, and B may be added to further improve properties. The reasons for the limitations on each of the chemical elements will be described.

Nb: 0.2% or Less

Since Nb forms fine Nb carbonitrides so as to form a fine microstructure and so as to improve delayed fracture resistance through a hydrogen trapping effect, Nb may be added as needed. In the case where the Nb content is more than 0.2%, the effect of forming a fine microstructure becomes saturated, and there is a deterioration in the strength-ductility balance and delayed fracture resistance as a result of Nb combining with Ti to form complex carbides having a large grain diameter in the presence of Ti. Therefore, in the case where Nb is added, the Nb content is set to be 0.2% or less, preferably 0.1% or less, or more preferably 0.05% or less. Although there is no particular limitation on the lower limit of the Nb content in the present invention, it is preferable that the Nb content be at least 0.004% or more in order to realize the effects described above.

Ti: 0.2% or Less

Since Ti is effective for forming a fine microstructure and for trapping hydrogen by forming carbides, Ti may be added as needed. In the case where the Ti content is more than 0.2%, the effect of forming a fine microstructure becomes saturated, and there is a deterioration in the strength-ductility balance and delayed fracture resistance as a result of Ti forming TiN having a large grain diameter and forming Ti—Nb complex carbides in the presence of Nb. Therefore, in the case where Ti is added, the Ti content is set to be 0.2% or less, preferably 0.1% or less, or more preferably 0.05% or less. Although there is no particular limitation on the lower limit of the Ti content in the present invention, it is preferable that the Ti content be at least 0.004% or more in order to realize the effects described above.

V: 0.5% or Less

Since fine carbides which are formed as a result of V combining with C are effective for increasing the strength of a steel sheet through precipitation strengthening and for improving delayed fracture resistance by functioning as hydrogen trapping sites, V may be added as needed. In the case where the V content is more than 0.5%, since an excessive amount of carbides is precipitated, there is a deterioration in the strength-ductility balance. Therefore, in the case where V is added, the V content is set to be 0.5% or less, preferably 0.1% or less, or more preferably 0.05% or less. Although there is no particular limitation on the lower limit of the V content in the present invention, it is preferable that the V content be at least 0.004% or more in order to realize the effects described above.

Mo: 0.3% or Less

Since Mo is effective for increasing the hardenability of a steel sheet and for trapping hydrogen through the use of fine precipitates, Mo may be added as needed. In the case where the Mo content is more than 0.3%, such effects become saturated, and there is a significant decrease in the chemical convertibility of a steel sheet as a result of the formation of Mo oxides on the surface of the steel sheet being promoted when continuous annealing is performed. Therefore, in the case where Mo is added, the Mo content is set to be 0.3% or less, preferably 0.1% or less, or more preferably 0.05% or less. Although there is no particular limitation on the lower limit of the Mo content in the present invention, it is preferable that the Mo content be at least 0.005% or more in order to realize the effects described above.

Cr: 1.0% or Less

Since Cr is, like Mo, effective for increasing the hardenability of a steel sheet, Cr may be added as needed. In the case where the Cr content is more than 1.0%, since it is not possible to completely remove Cr oxides on the surface of a steel sheet even if pickling is performed after continuous annealing has been performed, there is a significant decrease in the chemical convertibility of the steel sheet. Therefore, in the case where Cr is added, the Cr content is set to be 1.0% or less, preferably 0.5% or less, or more preferably 0.1% or less. Although there is no particular limitation on the lower limit of the Cr content in the present invention, it is preferable that the Cr content be at least 0.04% or more in order to realize the effect described above.

B: 0.005% or Less

Since B facilitates the formation of tempered martensite by inhibiting austenite from transforming into ferrite or bainite when cooling for continuous annealing is performed as a result of being segregated at austenite grain boundaries when heating for continuous annealing is performed, B is effective for increasing the strength of a steel sheet. In addition, B improves delayed fracture resistance through grain boundary strengthening. Therefore, B may be added as needed. In the case where the B content is more than 0.005%, there is a deterioration in formability and a decrease in strength due to the formation of boron carbide $Fe_{23}(C,B)_6$. Therefore, in the case where B is added, the B content is set to be 0.005% or less, or preferably 0.003% or less. Although there is no particular limitation on the lower limit of the B content in the present invention, it is preferable that the B content be at least 0.0002% or more in order to realize the effects described above.

In the present invention, one or more of Sn, Sb, W, Co, Ca, and REM may be added within ranges in which there is no negative effect on the properties. The reasons for the limitations on these chemical elements will be described.

Sn, Sb: 0.1% or Less

Since Sn and Sb are both effective for inhibiting oxidation, decarburization, and nitriding on the surface, Sn or Sb may be added as needed. However, in the case where the content of each of Sn and Sb is more than 0.1%, the effects described above become saturated. Therefore, in the case where Sn or Sb is added, the content of each of these chemical elements is set to be 0.1% or less, or preferably 0.05% or less. Although there is no particular limitation on the lower limit of the content of each of these chemical elements in the present invention, it is preferable that the content of each of these chemical elements be at least 0.001% or more in order to realize the effects described above.

W, Co: 0.1% or Less

Since W and Co are both effective for improving the properties of a steel sheet through the shape control of sulfides, grain boundary strengthening, and solid solution strengthening, W or Co may be added as needed. However, in the case where the content of each of W and Co is excessively large, there is a decrease in ductility due to, for example, grain boundary segregation. Therefore, it is preferable that the content of each of these chemical elements be 0.1% or less, or more preferably 0.05% or less. Although there is no particular limitation on the lower limit of the content of each of these chemical elements in the present invention, it is preferable that the content of each of these chemical elements be at least 0.01% or more in order to realize the effects described above.

Ca, REM: 0.005% or Less

Since Ca and REM are both effective for increasing ductility and improving delayed fracture resistance through the shape control of sulfides, Ca or REM may be added as needed. However, in the case where the content of each of Ca and REM is excessively large, there is a decrease in ductility due to, for example, grain boundary segregation. Therefore, it is preferable that the content of each of these chemical elements be 0.005% or less, or more preferably 0.002% or less. Although there is no particular limitation on the lower limit of the content of these chemical elements in the present invention, it is preferable that the content of each of these chemical elements be at least 0.0002% or more in order to realize the effects described above.

The remainder which is different from the constituent chemical elements described above is Fe and inevitable impurities.

Hereafter, the surface state of the high-strength steel sheet according to embodiments of the present invention will be described.

Steel Sheet Surface Coverage of Oxides Mainly Containing Si: 1% or Less

In the case where oxides mainly containing Si exist on the surface of a steel sheet, there is a significant decrease in chemical convertibility. Therefore, the steel sheet surface coverage of oxides mainly containing Si is set to be 1% or less, or preferably 0%. Here, examples of oxides mainly containing Si include $SiO_2$. In addition, it is possible to determine the amounts of oxides mainly containing Si by using the method described in EXAMPLES below. Here, the term "mainly containing Si" denotes a case where the proportion of Si in oxide-constituting chemical elements other than oxygen is 70% or more in terms of atomic concentration.

Steel Sheet Surface Coverage of Iron-Based Oxides: 40% or Less

In the case where the steel sheet surface coverage of iron-based oxides is more than 85%, since the dissolving reaction of iron in a chemical conversion treatment is inhibited, the growth of chemical conversion crystals such as zinc phosphate is inhibited. Nowadays, the temperature of a chemical conversion solution is decreased from the viewpoint of saving manufacturing costs, which results in a chemical conversion treatment being performed under conditions more severe than ever. Therefore, it is not possible to perform sufficient treatment even in the case where the steel sheet surface coverage of iron-based oxides is 85% or less, and it is preferable that the steel sheet surface coverage of iron-based oxides be 40% or less, or more preferably 35% or less. Although there is no particular limitation on the lower limit of the coverage, the steel sheet surface coverage of iron-based oxides is 20% or more in many cases. In addition, it is possible to determine the steel sheet surface coverage of iron-based oxides by using the method described in EXAMPLES below. Here, the term "iron-based oxides" denotes oxides mainly containing iron in which the proportion of iron in oxide-constituting chemical elements other than oxygen is 30% or more in terms of atomic concentration.

$Cu_S/Cu_B$: 4.0 or Less

It is not possible to sufficiently realize the effects according to embodiments of the present invention only by controlling the Si content and the Cu content to be within the ranges described above, and it is necessary to control Cu concentration distribution in the surface of a steel sheet in a pickling process for removing Si-containing oxides. That is, in embodiments of the present invention, it is necessary to control the Cu content to be 0.05% or more and 0.50% or less and to control $Cu_S/Cu_B$ ($Cu_S$ denotes a Cu concentration in the surface layer of a steel sheet, and $Cu_B$ denotes a Cu concentration in base steel) to be 4.0 or less. It is possible to achieve such a Cu concentration distribution by controlling weight reduction due to pickling to be within the range according to relational expression (1) below when a pickling treatment following continuous annealing is performed. Although there is no particular limitation on the lower limit of $Cu_S/Cu_B$, it is preferable that $Cu_S/Cu_B$ be 2.0 or more from the viewpoint of increasing chemical convertibility. Here, the term "surface layer of a steel sheet" denotes a region within 20 nm of the surface of a steel sheet in the thickness direction.

$$WR \leq 33.25 \times \exp(-7.1 \times [Cu\ \%]) \quad (1)$$

(WR: weight reduction due to pickling ($g/m^2$), [Cu %]: Cu content in steel)

Although it is possible to achieve the Cu concentration distribution described above by removing Cu which is re-precipitated on the surface of a steel sheet by performing, for example, grinding, it is not possible to achieve excellent chemical convertibility due to grinding flaws remaining. $Cu_S/Cu_B$ was determined by using the method described in EXAMPLES below.

Hereafter, the preferable steel microstructure of the high-strength cold-rolled steel sheet according to embodiments of the present invention will be described.

It is preferable that tempered martensite and/or bainite be included in an amount of 40% or more and 100% or less in terms of total volume ratio. Tempered martensite and/or bainite are phases which are indispensable for increasing the strength of steel. In the case where the volume ratio of these phases is less than 40%, there is a risk in that it is not possible to achieve a tensile strength of 1180 MPa or more.

It is preferable that ferrite be included in an amount of 0% or more and 60% or less in terms of volume ratio. Since ferrite contributes to an increase in ductility, ferrite may be included as needed in order to improve the formability of steel. It is possible to realize such an effect in the case where the volume ratio is more than 0%. In the case where the volume ratio is more than 60%, it is necessary to significantly increase the hardness of tempered martensite or bainite in order to achieve a tensile strength of 1180 MPa or more, which results in delayed fracture being promoted due to the concentration of stress and strain at interfaces between phases caused by the difference in hardness between phases.

It is preferable that retained austenite be included in an amount of 2% or more and 30% or less in terms of volume ratio. Retained austenite improves the strength-ductility balance of steel. It is possible to realize such an effect in the case where the volume ratio is 2% or more. Although there is no particular limitation on the lower limit of the volume ratio of retained austenite in the present invention, it is preferable that the volume ratio be 5% or more in order to stably achieve a (tensile strength×total elongation) of 16500 MPa·% or more. On the other hand, retained austenite transforms into hard tempered martensite when being subjected to work, which results in delayed fracture being promoted due to the concentration of stress and strain at interfaces between phases caused by the difference in hardness between phases as described above. Therefore, the upper limit of the volume ratio is set to be 30%. Here, in embodiments of the present invention, the average aspect ratio of retained austenite is more than 2.0.

In addition, in the present invention, the steel sheet microstructure may include additional phases other than tempered martensite, bainite, ferrite, and retained austenite described above. For example, pearlite, quenched martensite, and so forth may be included. It is preferable that the volume ratio of the additional phases be 5% or less from the viewpoint of realizing the effects of the present invention.

Here, the volume ratio described above is determined by using the method described in EXAMPLES below.

Hereafter, a method for manufacturing the high-strength cold-rolled steel sheet according to embodiments of the present invention will be described. In embodiments of the present invention, by using a slab which is obtained through the use of a continuous casting method as a steel raw material, by performing hot rolling, by cooling the hot-rolled steel sheet after finish rolling has been performed, by coiling the cooled steel sheet, by performing pickling on the coiled steel sheet, by performing cold rolling on the pickled steel sheet, by performing continuous annealing followed by an over-aging treatment on the cold-rolled steel sheet, by performing pickling on the treated steel sheet, and by preforming pickling again, a cold-rolled steel sheet is manufactured.

In the present invention, processes from a steel-making process to a cold rolling process may be performed by using commonly used methods. It is possible to manufacture the high-strength cold-rolled steel sheet according to embodiments of the present invention by performing continuous annealing, an over-aging treatment, and a pickling treatment under the conditions described below.

Continuous Annealing Conditions

In the case where an annealing temperature is lower than the $Ac_1$ point, since austenite which transforms into martensite after quenching has been performed and which is necessary to achieve the specified strength is not formed when annealing is performed, it is not possible to achieve a tensile strength of 1180 MPa or more even if quenching is performed after annealing has been performed. Therefore, it is preferable that the annealing temperature be equal to or higher than the $Ac_1$ point. It is preferable that the annealing temperature be 800° C. or higher from the viewpoint of stably ensuring that the equilibrium area ratio of austenite is 40% or more. In addition, in the case where a retention (holding) time at the annealing temperature is excessively short, since a steel microstructure is not subjected to sufficient annealing, an inhomogeneous microstructure in which a worked microstructure formed by performing cold rolling remains is formed, which results in a decrease in ductility. On the other hand, it is not preferable that the retention time be excessively long from the viewpoint of manufacturing costs, because this results in an increase in manufacturing time. Therefore, it is preferable that the retention time be 30 seconds to 1200 seconds. It is particularly preferable that the retention time be 250 seconds to 600 seconds.

In the present invention, the $Ac_1$ point (° C.) is derived by using the equation below. In the equation below, under the assumption that symbol X is used instead of the atomic symbol of some constituent chemical element of a steel sheet, [X %] denotes the content (mass %) of the chemical element represented by symbol X, and [X %] is assigned a value of 0 in the case of a chemical element which is not contained.

$$Ac_1 = 723 - 10.7 \times [Mn\ \%] + 29.1 \times [Si\ \%] + 16.9 \times [Cr\ \%] + 6.38 \times [W\ \%]$$

The cold-rolled steel sheet after annealing has been performed is cooled by controlling an average cooling rate of 3° C./s or more to a primary cooling stop temperature in a range equal to or higher than (Ms−100° C.) and lower than the Ms temperature. This cooling is intended to allow part of austenite to transform into martensite by performing cooling to a temperature lower than the Ms temperature. Here, in the case where the lower limit of the primary cooling stop temperature range is lower than (Ms−100° C.), since an excessive amount of untransformed austenite transforms into martensite at this time, it is not possible to simultaneously achieve excellent strength and excellent formability. On the other hand, in the case where the upper limit of the primary cooling stop temperature is equal to or higher than the Ms temperature, it is not possible to form an appropriate amount of tempered martensite. Therefore, the primary cooling stop temperature is set to be equal to or higher than (Ms−100° C.) and lower than the Ms temperature, preferably (Ms−80° C.) and lower than the Ms temperature, or more preferably (Ms−50° C.) and lower than the Ms temperature. In addition, in the case where the average cooling rate is less than 3° C./s, since an excessive amount of ferrite is formed and grows, and since, for example, pearlite is precipitated, it is not possible to form the desired microstructure. Therefore, the average cooling rate from the annealing temperature to the primary cooling stop temperature range is set to be 3° C./s or more, preferably 5° C./s or more, or more preferably 8° C./s or more. There is no particular limitation on the upper limit of the average cooling rate as long as there is no variation in the cooling stop temperature. Here, it is possible to derive the Ms temperature described above by using the approximate equation below. Ms is an approximate value which is derived on an empirical basis.

$$Ms(^\circ\text{ C.})=565-31\times[\text{Mn }\%]-13\times[\text{Si }\%]-10\times[\text{Cr }\%]-12\times[\text{Mo }\%]-600\times(1-\exp(-0.96\times[\text{C }\%]))$$

Here, under the assumption that symbol X is used instead of the atomic symbol of some constituent chemical element of a steel sheet, [X %] denotes the content (mass %) of the chemical element represented by symbol X, and [X %] is assigned a value of 0 in the case of a chemical element which is not contained.

Over-Aging Treatment Condition

The steel sheet which has been cooled to the primary cooling stop temperature range is heated to an over-aging temperature in a range of 300° C. or higher, equal to or lower than (Bs−50° C.), and 450° C. or lower and retained (held) in the over-aging temperature range for 15 seconds or more and 1000 seconds or less.

Bs denotes a temperature at which bainite transformation starts and it is possible to derive Bs by using the approximate equation below. Bs is an approximate value which is derived on an empirical basis.

$$Bs(^\circ\text{ C.})=830-270\times[\text{Co }\%]-90\times[\text{Mn }\%]-70\times[\text{Cr }\%]-83\times[\text{Mo }\%]$$

Here, under the assumption that symbol X is used instead of the atomic symbol of some constituent chemical element of a steel sheet, [X %] denotes the content (mass %) of the chemical element represented by symbol X, and [X %] is assigned a value of 0 in the case of a chemical element which is not contained.

In the over-aging temperature range, austenite is stabilized, for example, by tempering martensite, which is formed through the cooling from the annealing temperature to the primary cooling stop temperature range, by allowing untransformed austenite to transform into lower bainite, and by concentrating solid solution C in austenite. In the case where the upper limit of the over-aging temperature range is higher than (Bs−50° C.) or 450° C., bainite transformation is inhibited. On the other hand, in the case where the lower limit of the over-aging temperature range is lower than 300° C., since martensite is not sufficiently tempered, it is not possible to achieve the specified (tensile strength×total elongation). Therefore, the over-aging temperature is set to be 300° C. or higher, equal to or lower than (Bs−50° C.), and 450° C. or lower, or preferably 320° C. or higher, equal to or lower than (Bs−50° C.), and 420° C. or lower.

In addition, in the case where the retention time in the over-aging temperature range is less than 15 seconds, since martensite is not sufficiently tempered, and since lower bainite transformation does not sufficiently occur, it is not possible to form the desired steel microstructure, which may result in a case where it is not possible to achieve sufficient formability in an obtained steel sheet. Therefore, the retention time in the over-aging temperature range is set to be 15 seconds or more. On the other hand, a retention time of 1000 seconds in the over-aging temperature range is sufficient in embodiments of the present invention because of the effect of promoting bainite transformation through the use of martensite which is formed in the primary cooling stop temperature range. Although bainite transformation is usually delayed in the case where there is an increase in the amount of alloy chemical elements such as C, Cr, and Mn as in the case of embodiments of the present invention, there is a significant increase in bainite transformation rate in the case where martensite and untransformed austenite exist simultaneously as in the case of embodiments of the present invention. On the other hand, in the case where the retention time in the over-aging temperature range is more than 1000 seconds, since carbides are precipitated from untransformed austenite, which becomes retained austenite in the final microstructure of a steel sheet, it is not possible to form stable retained austenite in which C is concentrated, which may result in a case where it is not possible to achieve the desired strength and/or ductility. Therefore, the retention time is set to be 15 seconds or more and 1000 seconds or less, or preferably 100 seconds or more and 700 seconds or less.

Here, in the series of heat treatments in the present invention, the temperatures is not necessarily constant as long as the temperatures are within the specified ranges described above, and there is no decrease in the effects of the present invention even in the case where the temperatures vary within the specified ranges. This also applies to the cooling rates. In addition, a steel sheet may be subjected to the heat treatments by using any equipment as long as the thermal history conditions are satisfied. Moreover, performing skin pass rolling on the surface of a steel sheet for correcting its shape after the heat treatments have been performed is also within the scope of the present invention.

Pickling and Re-Pickling

There is no particular limitation on the chemical composition of a solution used for pickling. For example, any one of nitric acid, hydrochloric acid, hydrofluoric acid, sulfuric acid, and mixture of two or more of these acids may be used. Here, strongly oxidizing acids (such as nitric acid) are used in a pickling solution for pickling, and non-oxidizing acids, which are different from those used in a pickling solution for pickling, are used in a pickling solution for re-pickling.

By performing pickling on a steel sheet, after a tempering treatment (over-aging treatment) has been performed, through the use of a pickling solution having a nitric acid concentration of more than 50 g/L and 200 g/L or less, in which the ratio R ($HCl/HNO_3$) of the concentration of hydrochloric acid, which has an effect of breaking an oxide film, to the concentration of nitric acid is 0.01 to 1.0, or in which the ratio ($HF/HNO_3$) of the concentration of hydrofluoric acid to the concentration of nitric acid is 0.01 to 1.0, it is possible to remove oxides mainly containing Si and Si—Mn complex oxides on the surface of a steel sheet, which decrease chemical convertibility. However, as described above, it is preferable that the weight reduction due to pickling be controlled to be within the range according to relational expression (1) above in order to inhibit the influence of Cu which is re-precipitated on the surface of a steel sheet, so that there is a further increase in chemical convertibility. In addition, there may be a case where iron-based oxides which are formed by Fe dissolved from the surface of a steel sheet when picking is performed as described above are precipitated on the surface of the steel sheet and cover the surface of the steel sheet, which results in a decrease in chemical convertibility. Therefore, it is preferable that the iron-based oxides precipitated on the surface of a steel sheet be dissolved and removed by further performing re-pickling under appropriate conditions after pickling has been performed as described above. For this reason, non-oxidizing acids, which are different from those used in a pickling solution for pickling, are used in a pickling solution for re-pickling. Examples of non-oxidizing acids described above include hydrochloric acid, sulfuric acid, phosphoric acid, pyrophosphoric acid, formic acid, acetic acid, citric acid, hydrofluoric acid, oxalic acid, and mixture of two or more of these acids. For example, hydrochloric acid having a concentration of 0.1 g/L to 50 g/L, sulfuric acid having a concentration of 0.1 g/L to 150 g/L, mixture of hydrochloric acid having a concentration of 0.1 g/L to 20 g/L and sulfuric acid having a concentration of 0.1 g/L to 60 g/L, or the like can preferably be used.

EXAMPLES

By manufacturing slabs of sample molten steels having the chemical compositions given in Table 1 which had been prepared through the use of vacuum melting method, by heating the slabs to a temperature of 1250° C., by performing finish hot rolling with a finishing delivery temperature of 870° C., by coiling the hot-rolled steel sheets at a coiling temperature of 550° C., by pickling the hot-rolled steel sheets, by performing cold rolling with a rolling ratio (rolling reduction ratio) of 60%, cold-rolled steel sheets having a thickness of 1.2 mm were obtained. The obtained cold-rolled steel sheets were subjected to continuous annealing, a tempering treatment (over-aging treatment), pickling, and re-pickling under the conditions given in Table 2.

Metallographic structure (steel microstructure) observation, distribution analysis of Cu concentration in the surface layer, a tensile test, chemical convertibility evaluation, and delayed fracture resistance evaluation were performed on test pieces which were taken from the steel sheets obtained as described above.

Metallographic structure observation was performed on a thickness cross section parallel to the rolling direction which had been subjected to etching through the use of a nital solution by using a scanning electron microscope (SEM) in order to identify representative microstructure phases (steel microstructure phases). By performing image analysis on a SEM image taken at a magnification of 2000 times in order to determine the area ratio of ferrite region, the area ratio was defined as the volume ratio of ferrite. Here, in the case where pearlite (remaining microstructure) was formed, its volume ratio was determined in the same manner. Retained austenite was observed in a plane parallel to the surface of the steel sheet. By grinding the surface layer of the steel sheet to a position located at ¼ of the thickness, by thereafter performing chemical polishing, and by using an X-ray diffractometry, the volume ratio of retained austenite was determined. After the volume ratios of ferrite, pearlite, and retained austenite had been determined, the volume ratio of martensite and bainite was defined as the remainder. Here, in the case of the examples of embodiments of the present invention, the average aspect ratio of retained austenite was more than 2.0.

The Cu concentration distribution in the surface layer was evaluated by performing glow discharge optical emission spectrometry (GDS). GDS analysis was performed on a sample of 30 mm square which was prepared by shearing an object steel sheet through the use of GDA750 produced by Rigaku corporation with an anode of 8 mmϕ, a DC current of 50 mA, and a pressure of 2.9 hPa for a measuring time of 0 seconds to 200 seconds with a period of 0.1 seconds. Here, the sputter rate of a steel sheet under this discharging condition was about 20 nm/s. In addition, Fe: 371 nm, Si: 288 nm, Mn: 403 nm, and O: 130 nm were used as emission lines for measuring. Then, the ratio of an average intensity of Cu in a sputter time of 0 seconds to 1 second (corresponding to $Cu_S$) to an average intensity of Cu in a sputter time of 50 seconds to 100 seconds (corresponding to $Cu_B$) was determined.

A steel sheet surface coverage of oxides mainly containing Si was determined by observing the surface of a steel sheet through the use of a SEM at a magnification of 1000 times in five fields of view, by analyzing the observed fields of view through the use of EDX in order to identify oxides mainly containing Si, and by using a point-counting method.

By performing observation in five fields of view on the surface of a steel sheet through the use of a ultralow-acceleration-voltage-type scanning electron microscope (ULV-SEM: ULTRA55 produced by SEISS) with an acceleration voltage of 2 kV and an operation distance of 3.0 mm at a magnification of 1000 times, and by performing spectrometry through the use of an energy dispersive X-ray spectrometer (EDX: NSS312E produced by Thermo Fisher Scientific K.K.), backscattered electron images were obtained. By binarizing the backscattered electron images, by determining the area ratios of black regions, and by calculating the average value for the five fields of view, a steel sheet surface coverage of iron-based oxides was defined as the average value. Here, a threshold value used for the binarizing processing mentioned above was determined by using the following method.

By performing continuous casting on molten steel having a chemical composition containing C: 0.14 mass %, Si: 1.7 mass %, Mn: 1.3 mass %, P: 0.02 mass %, S: 0.002 mass %, Al: 0.035 mass %, and the balance being Fe and inevitable impurities which had been prepared by performing a commonly used refining process including, for example, a treatment utilizing a converter and a degassing treatment, slabs were manufactured. Subsequently, by reheating the slabs to a temperature of 1150° C., by performing hot rolling on the reheated slabs with a finishing delivery temperature of 850° C., by coiling the hot-rolled steel sheets at a coiling temperature of 550° C., hot-rolled steel sheets having a thickness of 3.2 mm were manufactured. Subsequently, by pickling the hot-rolled steel sheets in order to remove scale, by performing cold rolling on the pickled steel sheets, cold-rolled steel sheets having a thickness of 1.8 mm were manufactured. Subsequently, the cold-rolled steel sheets were subjected to continuous annealing in which the steel sheets were heated to a soaking temperature of 750° C., held for 30 seconds, then cooled from the soaking temperature to a cooling stop temperature of 400° C. at a cooling rate of 20°

Figure 2:
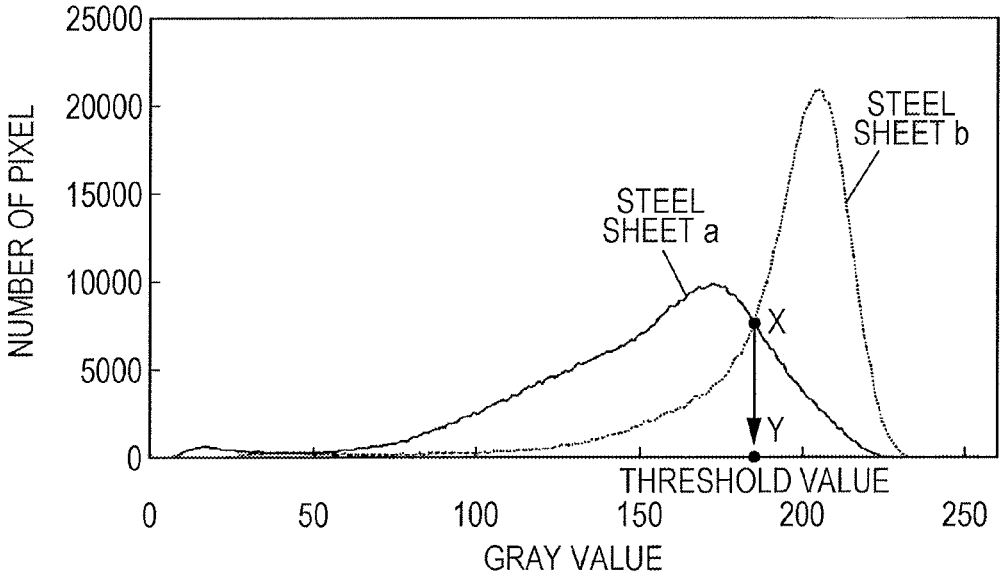
FIG. 2 is an example of a histogram in which the number of pixels in a backscattered electron image is measured along the vertical axis and a gray value is measured along the horizontal axis.

C./s, and held at the cooling stop temperature for 100 seconds. Subsequently, by performing pickling and re-pickling under the conditions given in Table 4, by rinsing the re-pickled steel sheets in water, by drying the rinsed steel sheets, and by performing skin pass rolling on the dried steel sheets with a rolling reduction ratio of 0.7%, two kinds of cold-rolled steel sheets having different amounts of iron-based oxides on surfaces thereof, that is, steel sheet codes a and b, were manufactured. Subsequently, by using cold-rolled steel sheet code a described above as a standard sample having a large amount of iron-based oxides, and by using cold-rolled steel sheet code b described above as a standard sample having a small amount of iron-based oxides, the backscattered electron image of each of the cold-rolled steel sheets was obtained under the conditions described above. FIG. 2 is a histogram in which the number of pixels in the backscattered electron image described above is measured along the vertical axis and a gray value (a parameter value for indicating a medium tone from white to black) is measured along the horizontal axis. In the present invention, a threshold value is defined as the gray value (point Y) corresponding to the intersection (point X) of the histogram of steel sheet codes a and b, and the area ratio of the regions having gray values equal to or less than the threshold value (dark tones) is defined as the surface coverage of iron-based oxides. Here, as a result of determining the surface coverages of iron-based oxides of steel sheet codes a and b, the coverage of steel sheet code a was 85.3%, and the coverage of steel sheet code b was 25.8%.

A tensile test was performed with a strain rate of $3.3\times10^{-3}$ $s^{-1}$ on a JIS No. 5 tensile test piece (gauge length: 50 mm, parallel part length: 25 mm) which was taken from a plane parallel to the surface of a steel sheet so that the tensile direction was perpendicular to the rolling direction.

In order to evaluate chemical convertibility, a chemical conversion treatment was performed by using a degreasing agent (Surfcleaner EC90 produced by Nippon Paint Co., Ltd.), a surface conditioner (5N-10 produced by Nippon Paint Co., Ltd.), and a chemical conversion agent (Surfdine EC1000 produced by Nippon Paint Co., Ltd.) under the standard condition described below so that coating weight of a chemical conversion coating film was 1.7 $g/m^2$ to 3.0 $g/m^2$.

<Standard Condition>

Degreasing process: at a treatment temperature of 45° C. for a treatment time of 120 seconds Spray degreasing and surface conditioning process: with a pH of 8.5 at room temperature for a treatment time of 30 seconds Chemical conversion process: in a chemical conversion solution having a temperature of 40° C. for a treatment time of 90 seconds By performing observation in 5 fields of view on the surface of a steel sheet which had been subjected to a chemical conversion treatment through the use of a SEM at a magnification of 500 times, a case where chemical conversion crystals are homogeneously formed in 95% or more the area of each of the 5 fields of view was judged as good, that is, "O", and a case where a lack of hiding was observed in more than 5% the area of at least one of the 5 fields of view was judged as poor, that is, "x".

Delayed fracture resistance was evaluated by performing an immersion test. By taking a sample of 35 m×105 mm so that a longitudinal direction thereof was perpendicular to the rolling direction, and by grinding the ends of the sample, a test piece of 30 mm×100 mm was prepared. The test piece was bent at an angle of 180° by using a punch having a tip curvature radius of 10 mm so that a ridge line at the bending position was parallel to the rolling direction, and, as illustrated in FIG. 1, stress was applied to the bent test piece 1 by squeezing the test piece with a bolt 2 so that the inner spacing of the test piece was 10 mm. By immersing the test piece under stress in hydrochloric acid having a temperature of 25° C. and a pH of 3, a time until fracture occurred was determined within a range of 100 hours. A case where the time until fracture occurred was less than 40 hours was judged as "x", a case where the time until fracture occurred was 40 hours or more and less than 100 hours was judged as "O", and a case where fracture did not occur within 100 hours was judged as "⊙". In addition, a case where the time until fracture occurred was 40 hours or more was judged as a case of excellent delayed fracture resistance.

The results obtained as described above are given in Table 3.

As indicated in Table 1 through Table 3, it is clarified that the examples of embodiments of the present invention had a tensile strength of 1180 MPa or more, excellent chemical convertibility, and excellent delayed fracture resistance represented by a time until fracture occurred of more than 100 hours in the delayed fracture resistance evaluation.

Nos. 11 through 18 are examples having chemical compositions out of the range of embodiments of the present invention.

In the case of No. 11 where the C content was small, it was not possible to achieve the specified microstructure and tensile strength.

In the case of No. 12 where the C content was large, there was an increase in the grain diameter of carbides, which resulted in poor delayed fracture resistance.

In the case of No. 13 where the Si content was small, there was an increase in the grain diameter of carbides, which resulted in poor delayed fracture resistance.

In the case of No. 14 where the Si content was large, Si-containing oxides on the surface of the steel sheet were not sufficiently removed by performing pickling, which resulted in poor chemical convertibility. In the case where weight reduction due to pickling is increased, since Cu concentration distribution in the surface layer is larger than the specified range, there is no increase in chemical convertibility.

In the case of No. 15 where the Cu content was small, there was poor delayed fracture resistance.

In the case of No. 16 where the Cu content was large, it was difficult to control pickling conditions so that the specified Cu concentration distribution in the surface layer was achieved. Although an attempt was made to control weight reduction due to pickling to be small in the case of No. 16, since a sufficient amount of Si-containing oxides was not removed, there was poor chemical convertibility.

Nos. 17 through 21 are example steels and comparative example steels of which manufacturing methods were out of the preferable range according to the present invention.

In the case of No. 17 or 18 where the microstructure thereof was out of the preferable range, the example steel had a TS×El of less than 16500, although excellent strength, chemical convertibility, and delayed fracture resistance were achieved.

In the case of No. 19 where pickling was not performed after continuous annealing had been performed, Si-containing oxides were retained on the surface of the steel sheet, which resulted in poor chemical convertibility.

In the case of No. 20 where weight reduction due to pickling was large, it was not possible to achieve the Cu concentration distribution in the surface layer specified in embodiments of the present invention, which resulted in poor chemical convertibility.

In the case of No. 21 where re-pickling following pickling was omitted, iron-based oxides were retained on the surface of the steel sheet, which resulted in poor chemical convertibility.

TABLE 1

| Steel | Chemical Composition (mass %) | | | | | | | | | | | | | | | $A_{C1}$ | Ms | Bs | |
|---|---|---|---|---|---|---|---|---|---|---|---|---|---|---|---|---|---|---|---|
| Grade | C | Si | Mn | P | S | Al | N | Cu | Nb | Ti | Mo | Cr | B | Other | Si/Mn | (° C.) | (° C.) | (° C.) | Note |
| A | 0.21 | 1.5 | 3.5 | 0.011 | 0.002 | 0.03 | 0.0036 | 0.18 | 0 | 0 | 0 | 0 | 0.0012 | 0 | 0.43 | 729 | 327 | 458 | within Scope of Invention |
| B | 0.24 | 1.5 | 2.7 | 0.013 | 0.001 | 0.03 | 0.0032 | 0.15 | 0.02 | 0 | 0 | 0 | 0 | 0 | 0.56 | 738 | 338 | 522 | within Scope of Invention |
| C | 0.27 | 1.8 | 4.2 | 0.017 | 0.002 | 0.05 | 0.0044 | 0.10 | 0.01 | 0 | 0 | 0 | 0 | 0 | 0.43 | 730 | 274 | 379 | within Scope of Invention |
| D | 0.33 | 2.2 | 2.8 | 0.015 | 0.002 | 0.05 | 0.0045 | 0.08 | 0 | 0 | 0 | 0 | 0 | 0 | 0.79 | 757 | 287 | 489 | within Scope of Invention |
| E | 0.35 | 1.6 | 4.0 | 0.008 | 0.002 | 0.03 | 0.0030 | 0.18 | 0 | 0 | 0.01 | 0 | 0 | 0 | 0.41 | 728 | 248 | 375 | within Scope of Invention |
| F | 0.38 | 1.6 | 3.8 | 0.014 | 0.001 | 0.04 | 0.0037 | 0.20 | 0 | 0 | 0 | 0 | 0.0008 | 0 | 0.42 | 728 | 243 | 385 | within Scope of Invention |
| G | 0.37 | 2.2 | 2.8 | 0.015 | 0.001 | 0.04 | 0.0044 | 0.08 | 0 | 0 | 0 | 0.20 | 0 | 0 | 0.79 | 757 | 270 | 478 | within Scope of Invention |
| H | 0.33 | 1.6 | 3.0 | 0.014 | 0.001 | 0.04 | 0.0032 | 0.16 | 0 | 0.03 | 0 | 0 | 0.0010 | 0 | 0.53 | 737 | 288 | 471 | within Scope of Invention |
| I | 0.21 | 1.5 | 3.5 | 0.011 | 0.002 | 0.03 | 0.0034 | 0.17 | 0 | 0 | 0 | 0 | 0.0012 | Sn: 0.002, Sb: 0.002 W: 0.015, Co: 0.018 | 0.44 | 730 | 327 | 458 | within Scope of Invention |
| J | 0.21 | 1.5 | 3.5 | 0.011 | 0.002 | 0.03 | 0.0031 | 0.20 | 0 | 0 | 0 | 0 | 0.0012 | V: 0.12, Ca: 0.001, REM: 0.0005 | 0.44 | 730 | 327 | 458 | within Scope of Invention |
| K | 0.09 | 1.6 | 3.4 | 0.012 | 0.002 | 0.03 | 0.0031 | 0.15 | 0 | 0 | 0 | 0 | 0 | 0 | 0.47 | 733 | 389 | 500 | out of Scope of Invention |
| L | 0.65 | 1.5 | 3.5 | 0.017 | 0.001 | 0.05 | 0.0033 | 0.10 | 0 | 0 | 0 | 0 | 0 | 0 | 0.43 | 729 | 158 | 340 | out of Scope of Invention |
| M | 0.22 | 0.8 | 3.4 | 0.015 | 0.001 | 0.05 | 0.0034 | 0.16 | 0 | 0 | 0 | 0 | 0 | 0 | 0.24 | 710 | 335 | 465 | out of Scope of Invention |
| N | 0.21 | 3.4 | 3.2 | 0.008 | 0.001 | 0.03 | 0.0030 | 0.18 | 0 | 0 | 0 | 0 | 0 | 0 | 1.06 | 788 | 312 | 485 | out of Scope of Invention |
| O | 0.28 | 1.8 | 2.8 | 0.016 | 0.001 | 0.03 | 0.0039 | 0.03 | 0 | 0 | 0 | 0 | 0 | 0 | 0.64 | 745 | 313 | 502 | out of Scope of Invention |
| P | 0.26 | 1.6 | 3.0 | 0.012 | 0.001 | 0.03 | 0.0036 | 0.53 | 0 | 0 | 0 | 0 | 0 | 0 | 0.53 | 737 | 319 | 490 | out of Scope of Invention |

* "0" indicates that the chemical element is not added, and underlined portions indicate conditions out of the range of the present invention.

TABLE 2

| | | Annealing Process | | | | Over-aging Process | |
|---|---|---|---|---|---|---|---|
| No. | Steel Grade | Annealing Temperature (° C.) | Holding Time (sec) | Average Primary Cooling Rate (° C./sec) | Primary Cooling Stop Temperature (° C.) | Over-aging Temperature (° C.) | Holding Time (sec) |
| 1 | A | 880 | 300 | 12 | 290 | 380 | 400 |
| 2 | B | 880 | 300 | 9 | 290 | 420 | 500 |
| 3 | C | 880 | 300 | 6 | 200 | 320 | 500 |
| 4 | D | 880 | 300 | 8 | 240 | 370 | 300 |
| 5 | E | 880 | 300 | 14 | 210 | 310 | 600 |
| 6 | F | 880 | 300 | 11 | 210 | 320 | 700 |
| 7 | G | 880 | 300 | 13 | 200 | 380 | 600 |
| 8 | H | 880 | 300 | 8 | 250 | 370 | 500 |
| 9 | I | 880 | 300 | 6 | 290 | 380 | 400 |
| 10 | J | 880 | 300 | 14 | 290 | 380 | 400 |
| 11 | K | 880 | 300 | 12 | 290 | 380 | 400 |
| 12 | L | 880 | 300 | 9 | 130 | 300 | 400 |
| 13 | M | 880 | 300 | 12 | 290 | 380 | 400 |
| 14 | N | 880 | 300 | 6 | 290 | 380 | 400 |
| 15 | O | 880 | 300 | 8 | 290 | 380 | 400 |
| 16 | P | 880 | 300 | 15 | 290 | 380 | 400 |
| 17 | A | 880 | 300 | 12 | 200 | 380 | 400 |
| 18 | A | 880 | 300 | 10 | 290 | 500 | 400 |
| 19 | A | 880 | 300 | 12 | 290 | 380 | 400 |
| 20 | A | 880 | 300 | 12 | 290 | 380 | 400 |
| 21 | A | 880 | 300 | 11 | 290 | 380 | 400 |

| | Pickling Condition | | | Re-pickling Condition | | | Weight Reduction |
|---|---|---|---|---|---|---|---|
| No. | Acid Concentration (g/l) | Temperature (° C.) | Treatment Time (sec) | Acid Concentration (g/l) | Temperature (° C.) | Treatment Time (sec) | due to Pickling ($g/m^2$) |
| 1 | Nitric Acid: 150 + | 40 | 10 | Hydrochloric Acid: 3 | 50 | 10 | 8.7 |
| 2 | Hydrochloric | 40 | 10 | | | | 8.7 |
| | Acid: 15 | | | | | | |
| 3 | Nitric Acid: 150 + | 50 | 10 | Hydrochloric | 50 | 10 | 14.4 |
| 4 | Hydrochloric | 50 | 12 | Acid: 10 + | | | 17.7 |
| | Acid: 15 | | | Sulfuric Acid: 50 | | | |
| 5 | | 45 | 8 | Hydrochloric Acid: 5 + | 50 | 10 | 8.8 |
| 6 | | 45 | 7 | Sulfuric Acid: 5 | | | 7.5 |
| 7 | Nitric Acid: 100 + | 50 | 15 | Sulfuric Acid: 75 | 50 | 10 | 18.3 |
| 8 | Hydrochloric | 50 | 10 | | | | 10.0 |
| 9 | Acid: 20 | 55 | 8 | Sulfuric Acid: 150 | 50 | 10 | 9.0 |
| 10 | | 55 | 7 | | | | 7.1 |
| 11 | | 55 | 9 | | | | 10.9 |
| 12 | | 55 | 9 | | | | 10.9 |
| 13 | | 40 | 12 | Hydrochloric Acid: 5 + | 50 | 10 | 6.5 |
| 14 | | 40 | 14 | Sulfuric Acid: 8 | | | 8.6 |
| 15 | Nitric Acid: 150 + | 45 | 12 | Hydrochloric Acid: 50 | 50 | 10 | 12.8 |
| 16 | Hydrochloric | 40 | 4 | | | | 0.8 |
| | Acid: 20 | | | | | | |
| 17 | Nitric Acid: 150 + | 40 | 10 | Hydrochloric | 50 | 10 | 8.7 |
| 18 | Hydrochloric | 40 | 10 | Acid: 10 + | | | 8.7 |
| | Acid: 15 | | | Sulfuric Acid: 50 | | | |
| 19 | — | — | — | — | — | — | 0.0 |
| 20 | Nitric Acid: 150 + | 50 | 20 | Hydrochloric | 50 | 10 | 30.9 |
| | Hydrochloric | | | Acid: 10 + | | | |
| | Acid: 15 | | | Sulfuric Acid: 50 | | | |
| 21 | | 40 | 10 | — | — | — | 8.7 |

TABLE 3

| No. | Steel Grade | Volume Ratio of Ferrite (%) | Volume Ratio of Martensite and Bainite (%) | Volume Ratio of Retained Austenite (%) | Volume Ratio of Remaining Microstructure (%) | Tensile Strength (MPa) | Total Elongation (%) | Tensile Strength × Total Elongation (MPa · %) | Surface Coverage: Oxide Mainly containing Si (%) | Surface Coverage: Iron-based Oxide (%) | $Cu_s/Cu_b$ | Chemical convertibility | Delayed Fracture Resistance | Note |
|---|---|---|---|---|---|---|---|---|---|---|---|---|---|---|
| 1 | A | 0 | 88 | 12 | 0 | 1358 | 16 | 21728 | 0 | 27 | 3.9 | ○ | ⊙ | Example |
| 2 | B | 0 | 84 | 16 | 0 | 1471 | 18 | 26478 | 0 | 34 | 3.3 | ○ | ⊙ | Example |
| 3 | C | 0 | 83 | 17 | 0 | 1426 | 16 | 22816 | 0 | 38 | 3.6 | ○ | ○ | Example |
| 4 | D | 0 | 77 | 23 | 0 | 1621 | 20 | 32420 | 0 | 34 | 3.8 | ○ | ○ | Example |
| 5 | E | 0 | 78 | 22 | 0 | 1664 | 21 | 34944 | 0 | 34 | 3.9 | ○ | ⊙ | Example |
| 6 | F | 0 | 73 | 27 | 0 | 1765 | 22 | 38830 | 0 | 28 | 3.8 | ○ | ⊙ | Example |
| 7 | G | 0 | 77 | 23 | 0 | 1721 | 19 | 32699 | 0 | 31 | 3.9 | ○ | ○ | Example |
| 8 | H | 0 | 77 | 23 | 0 | 1564 | 18 | 28152 | 0 | 36 | 3.8 | ○ | ⊙ | Example |
| 9 | I | 0 | 88 | 12 | 0 | 1352 | 16 | 21632 | 0 | 33 | 3.7 | ○ | ⊙ | Example |
| 10 | J | 0 | 88 | 12 | 0 | 1349 | 16 | 21584 | 0 | 32 | 3.6 | ○ | ⊙ | Example |
| 11 | K | 32 | 66 | 2 | 0 | 992 | 22 | 21824 | 0 | 27 | 3.9 | ○ | ⊙ | Comparative Example |
| 12 | L | 0 | 72 | 28 | 0 | 1826 | 22 | 40179 | 0 | 27 | 3.0 | ○ | × | Comparative Example |
| 13 | M | 0 | 80 | 2 | 8 | 1260 | 12 | 15120 | 0 | 30 | 2.8 | ○ | × | Comparative Example |
| 14 | N | 0 | 79 | 21 | 0 | 1492 | 20 | 29840 | 19 | 39 | 3.8 | × | ⊙ | Comparative Example |
| 15 | O | 0 | 85 | 15 | 0 | 1520 | 17 | 26448 | 0 | 25 | 2.4 | ○ | × | Comparative Example |
| 16 | P | 0 | 87 | 13 | 0 | 1498 | 15 | 22770 | 14 | 34 | 3.9 | × | ⊙ | Comparative Example |
| 17 | A | 0 | 98 | 2 | 0 | 1602 | 8 | 12816 | 0 | 29 | 3.9 | ○ | ⊙ | Example |
| 18 | A | 0 | 98 | 2 | 0 | 1562 | 8 | 13121 | 0 | 38 | 3.9 | ○ | ⊙ | Example |
| 19 | A | 0 | 88 | 12 | 0 | 1358 | 16 | 21728 | 23 | 58 | 1.0 | × | ⊙ | Comparative Example |
| 20 | A | 0 | 86 | 14 | 0 | 1325 | 17 | 22525 | 0 | 26 | 11.3 | × | ⊙ | Comparative Example |
| 21 | A | 0 | 85 | 15 | 0 | 1302 | 18 | 23436 | 0 | 55 | 3.9 | × | ⊙ | Comparative Example |

* Underlined portions indicate conditions out of the range of the present invention.

TABLE 4

| Steel Sheet | Pickling Condition: Acid Concentration (g/l) | Pickling Condition: Temperature (° C.) | Pickling Condition: Treatment Time (sec) | Re-Pickling Condition: Acid Concentration (g/l) | Re-Pickling Condition: Temperature (° C.) | Re-Pickling Condition: Treatment Time (sec) |
|---|---|---|---|---|---|---|
| a | Nitric Acid: 250 + Hydrochloric Acid: 25 | 40 | 10 | — | — | — |
| b | Nitric Acid: 150 + Hydrochloric Acid: 15 | 40 | 10 | Hydrochloric Acid: 10 | 40 | 30 |

REFERENCE SIGNS LIST

1 test piece

2 bolt

The invention claimed is:

1. A high-strength cold-rolled steel sheet having a chemical composition containing, by mass %, C: 0.10% or more and 0.6% or less, Si: 1.0% or more and 3.0% or less, Mn: more than 2.5% and 10.0% or less, P: 0.05% or less, S: 0.02% or less, Al: 0.01% or more and 1.5% or less, N: 0.005% or less, Cu: 0.05% or more and 0.50% or less, and the balance being Fe and inevitable impurities, wherein a steel sheet surface coverage of oxides mainly containing Si is 1% or less, a steel sheet surface coverage of iron-based oxides is 40% or less, $Cu_S/Cu_B$ is 2.0 or more and 4.0 or less, and a tensile strength is 1180 MPa or more, where $Cu_S$ denotes a Cu concentration in a surface layer of the steel sheet, and $Cu_B$ denotes a Cu concentration in base steel, and wherein the steel sheet has a microstructure including, in terms of volume ratio, tempered martensite and/or bainite in a total amount of 40% or more and 98% or less, ferrite in an amount of 0% or more and 60% or less, and retained austenite in an amount of 2% or more and 30% or less, and (tensile strength×total elongation) is 16500 MPa·% or more.

2. The high-strength cold-rolled steel sheet according to claim 1, wherein [Si]/[Mn] ([Si] denotes a Si content (mass %), and [Mn] denotes a Mn content (mass %)) is more than 0.40.

3. The high-strength cold-rolled steel sheet according to claim 1, wherein the steel sheet has the chemical composition further containing, by mass %, one or more of Nb: 0.2% or less, Ti: 0.2% or less, V: 0.5% or less,
Mo: 0.3% or less,
Cr: 1.0% or less, and
B: 0.005% or less.

4. The high-strength cold-rolled steel sheet according to claim 1, wherein the steel sheet has the chemical composition further containing, by mass %, one or more of
Sn: 0.1% or less,
Sb: 0.1% or less,
W: 0.1% or less,
Co: 0.1% or less,
Ca: 0.005% or less, and
EM: 0.005% or less.

5. The high-strength cold-rolled steel sheet according to claim 2, wherein the steel sheet has the chemical composition further containing, by mass %, one or more of
Nb: 0.2% or less,
Ti: 0.2% or less,
V: 0.5% or less,
Mo: 0.3% or less,
Cr: 1.0% or less, and
B: 0.005% or less.

6. The high-strength cold-rolled steel sheet according to claim 3, wherein the steel sheet has the chemical composition further containing, by mass %, one or more of
Nb: 0.2% or less,
Ti: 0.2% or less,
V: 0.5% or less,
Mo: 0.3% or less,
Cr: 1.0% or less, and
B: 0.005% or less.

7. The high-strength cold-rolled steel sheet according to claim 2, wherein the steel sheet has the chemical composition further containing, by mass %, one or more of
Sn: 0.1% or less,
Sb: 0.1% or less,
W: 0.1% or less,
Co: 0.1% or less,
Ca: 0.005% or less, and
REM: 0.005% or less.

8. The high-strength cold-rolled steel sheet according to claim 3, wherein the steel sheet has the chemical composition further containing, by mass %, one or more of
Sn: 0.1% or less,
Sb: 0.1% or less,
W: 0.1% or less,
Co: 0.1% or less,
Ca: 0.005% or less, and
REM: 0.005% or less.

9. The high-strength cold-rolled steel sheet according to claim 5, wherein the steel sheet has the chemical composition further containing, by mass %, one or more of
Sn: 0.1% or less,
Sb: 0.1% or less,
W: 0.1% or less,
Co: 0.1% or less,
Ca: 0.005% or less, and
REM: 0.005% or less.

10. The high-strength cold-rolled steel sheet according to claim 6, wherein the steel sheet has the chemical composition further containing, by mass %, one or more of
Sn: 0.1% or less,
Sb: 0.1% or less,
W: 0.1% or less,
Co: 0.1% or less,
Ca: 0.005% or less, and
REM: 0.005% or less.

11. The high-strength cold-rolled steel sheet according to claim 1, wherein the volume ratio of retained austenite is 5% or more and 30% or less.

* * * * *